US006439407B1

(12) United States Patent
Jacoff et al.

(10) Patent No.: US 6,439,407 B1
(45) Date of Patent: Aug. 27, 2002

(54) SYSTEM FOR STABILIZING AND CONTROLLING A HOISTED LOAD

(75) Inventors: Adam Stephan Jacoff, Rockville; Roger Vernon Bostelman, Frederick; James Sacra Albus, Kensington, all of MD (US)

(73) Assignee: The United States of America as represented by the Secretary of Commerce, Washington, DC (US)

( * ) Notice: Subject to any disclaimer, the term of this patent is extended or adjusted under 35 U.S.C. 154(b) by 0 days.

(21) Appl. No.: 09/350,998

(22) Filed: Jul. 12, 1999

Related U.S. Application Data

(60) Provisional application No. 60/092,527, filed on Jul. 13, 1998.

(51) Int. Cl.[7] ..... B66C 13/06

(52) U.S. Cl. ..... 212/274; 212/272; 212/273; 212/275

(58) Field of Search ..... 212/272, 273, 212/274, 275; 414/733

(56) References Cited

U.S. PATENT DOCUMENTS

| | | | |
|---|---|---|---|
| 3,567,040 | A | 3/1971 | Thomson |
| 3,591,022 | A | 7/1971 | Polyakov et al. |
| 3,653,518 | A | 4/1972 | Polen |
| 3,685,669 | A | 8/1972 | Morrison |
| 3,739,922 | A | 6/1973 | Hasegawa et al. |
| 3,743,107 | A | 7/1973 | Verschoof |
| 3,746,182 | A | 7/1973 | Tax et al. |
| 3,828,940 | A | 8/1974 | Cooper |
| 3,887,080 | A | 6/1975 | Wilson |
| 3,899,083 | A | 8/1975 | Flessner et al. |
| 3,900,114 | A | 8/1975 | Inoue et al. |
| 4,171,053 | A | 10/1979 | Cecce |
| 4,376,487 | A | 3/1983 | Van Soest et al. |
| 4,883,184 | A | 11/1989 | Albus |
| 4,932,541 | A | 6/1990 | Belsterling |
| 4,949,854 | A | 8/1990 | Foit |
| 4,949,855 | A | 8/1990 | Foit |
| 4,953,721 | A | 9/1990 | Foit |
| 5,150,799 | A | 9/1992 | Long, Jr. |
| 5,186,342 | A | 2/1993 | Shimizu |
| 5,257,891 | A | 11/1993 | Baumann et al. |
| 5,314,262 | A | 5/1994 | Meisinger et al. |
| 5,507,596 | A | 4/1996 | Bostelman et al. |
| 5,673,804 | A | 10/1997 | Weiss et al. |
| 5,765,703 | A | 6/1998 | Shiwaku |
| 5,769,250 | A | 6/1998 | Jussila et al. |

*Primary Examiner*—Eileen D. Lillis
*Assistant Examiner*—R. B. Johnson
(74) *Attorney, Agent, or Firm*—Stevens, Davis, Miller & Mosher, L.L.P.

(57) ABSTRACT

A system which can both be adapted to existing single point lift mechanisms, and constrain a hoisted load in all six degrees of freedom, includes a suspension point, an assembly, a lateral tension lines member, and a control system. The assembly includes first and second platforms connected by a plurality of control cables which can precisely control the position, velocity, and force of a hoisted element in six degrees of freedom. The position or tension of the control lines can be controlled either manually, automatically by computer, or in various combinations of manual and automatic control. Advantages associated with the system include not only the ability to control the position, velocity, and force of the attached load, tool, and/or equipment in six degrees of freedom using position and tension feedback, but its ready adaptation to existing single point lift mechanisms and relatively light weight, and its flexibility, ease, and precision of operation.

2 Claims, 11 Drawing Sheets

SYSTEM FOR STABILIZING AND CONTROLLING A HOISTED LOAD

This application claims the benefit of U.S. Provisional Application No. 60/092,527, filed Jul. 13, 1998.

The invention described herein may be manufactured, used, and licensed by the U.S. Government for governmental purposes without the payment of any royalties thereon.

BACKGROUND OF THE INVENTION

1. Field of the Invention

This invention relates generally to a system for stabilizing and controlling a hoisted load. The invention relates more specifically to a system for stabilizing and controlling in six degrees of freedom the movement of a hoisted load. The invention relates even more specifically to a system which can both be adapted to existing single point lift mechanisms, and constrain the load in all six degrees of freedom.

2. Description of Related Art

As discussed in U.S. Pat. No. 4,883,184, lifting platforms are commonly attached to cranes, such as overhead tower-type cranes having a horizontal boom and boom-type cranes having a diagonal boom. Applications for these lifting platforms can include transporting cargo on and off ships, and relocating necessary equipment and materials on a construction site.

The potential motions of a hoisted object can best be envisioned by means of a Cartesian coordinate system in which the z-axis is in the vertical direction, and the x and y axes form the horizontal plane. The rotation of the hoisted object about the z-axis is therefore defined as yaw, rotation about the x-axis is defined as pitch, and rotation about the y-axis is defined as roll.

In typical load transporting applications, a crane will have a single lifting cable. In these applications, the lifting cable is stable only in the z direction. Under any external influence from the sides, the load will either roll, pitch, or yaw, or will sway in the x and y directions.

The prior art has long recognized the need to compensate for these motions, and as a result, various conventional devices exist for attempting to stabilize a hoisted load. For example, U.S. Pat. No. 4,171,053 describes a crane for overcoming the undesirable effects of cargo pendulation. The crane consists of conventional booms, vertical hoist lines, and a hook member for engaging the cargo to be lifted and lowered. The crane also consists of a horizontal beam located at the base of the boom. The major portion of the hoist lines remains in substantially a vertical plane as a result of lines which extend from a guide means at the bottom of the hoist lines to the horizontal beam.

U.S. Pat. No. 4,883,184 describes a cable arrangement and lifting platform for lifting a load in a stabilized manner. The lifting platform secures loads to a securing device and the platform is able to be suspended from a crane by an attachment carriage. The attachment carriage includes a cable winch onto which six cables suspend and attach to the lifting platform. The attachment carriage also includes cable guides which guide the six cables away from the winch in three cable pairs, preferably equidistantly-spaced. In order to secure the cables to the lifting platform, the platform includes an attachment frame having three cable attachment points, preferably spaced equidistantly apart with respect to each other. The lifting platform helps stabilize the lifting of loads by sensing the load's imbalance relative to the center of mass of the platform and repositioning the load to correct for the imbalance.

U.S. Pat. No. 4,932,541 describes a stabilized cargo-handling system using means for stabilizing suspended cargo in all six degrees of freedom using six individually controlled cables in tension in a kinematic arrangement. Inertial and distance sensors, coupled with high-performance cable drives, provide the means to control the multi-cabled crane automatically. The distance sensors are used to track the target container or lighter vessel during the pickup and setdown modes of operation; the inertial sensors are used to prevent pendulation during transfer of the cargo from the seagoing cargo ship to the vicinity of the receiving lighter.

U.S. Pat. No. 5,507,596 describes an underwater work platform supported by a plurality of cables connected between a support structure and the work platform. Motions of the support structure in the body of water are sensed, and the length of the cables is adjusted in response to the sensed motion of the support structure so that the work platform can be maintained in a stationary position even when the support structure is subjected to wave forces and currents.

In the late 1980's the National Institute of Standards and Technology ("NIST") developed a concept known as RoboCrane based on a Stewart platform geometry parallel link manipulator, but which uses cables as the parallel links and winches as the actuators.

NIST also developed a version of the RoboCrane known as TETRA for testing long cable suspensions. TETRA includes winches mounted on the work platform as opposed to the supporting structure. TETRA's relatively light duty winch cables are used to augment existing heavy duty lift equipment (such as cranes) by attaching to the suspended load and then using RoboCrane control programs to provide intuitive load control in six degrees of freedom.

Single point lift mechanisms, such as boom-type cranes, typically include a base, a boom, and a heavy duty hoist system including a winch and block and tackle. As indicated above, however, load pendulation is a basic problem typical of such cranes since they can only control the vertical axis. Attempts at controlling load pendulation have included control programs that maneuver the lift point to stay above the load. Others attempts have included the use of reeving (like the RoboCrane) and vertical motion compensation.

A vessel known as a Tactical Auxiliary Crane Ship ("T-ACS") includes a system called the Rider Block Tagline System ("RBTS") that attempts to stabilize a load by pulling on taglines to prevent large pendulations. The RBTS, however, affords limited control of the spreader/cargo sway, and no rotational control of the spreader/cargo. Additionally, the RBTS introduces complex load motions that are difficult to dampen, so that operators often disable the system. Furthermore, the RBTS hinders performance and safety as a result of depth perception and line of sight occlusion, and requires the presence of ground personnel with tag lines in hazardous areas to guide the load. Routine RBTS operations, therefore, require precision boom control and a highly trained operator. Finally, the RBTS does not control the load in all six degrees of freedom.

While the aforementioned conventional devices may therefore provide varying degrees of control of a hoisted load, not all of these devices can control all six degrees of freedom, and none can both be adapted to existing single point lift mechanisms, and constrain the load in all six degrees of freedom, thus satisfying a long-felt need in this environment.

SUMMARY OF THE INVENTION

It is an object of the present invention to provide a system which can both be adapted to existing single point lift mechanisms, and constrain a hoisted load in all six degrees of freedom.

Accordingly, the present invention advantageously relates to a system for stabilizing and controlling in six degrees of freedom the movement of a hoisted load. The system comprises a suspension point, an assembly, a lateral tension lines member, and a control system. In a first embodiment, the assembly comprises a first platform for positioning the assembly; a second platform disposed below the first platform; first, second, third, fourth, fifth, and sixth, control lines having a first end and a second end, with the control lines disposed between first platform and the second platform; an assembly hoist, which comprises first, second, and third assembly hoist lines in communication with a corresponding one of each of first, second, and third assembly hoist line length adjusters; and a load hoist which comprises a load hoist line and a load hoist connector, with the load hoist line in communication with a load hoist line length adjuster.

The first platform comprises a first platform upper surface, a first platform lower surface, a first platform outer edge, load hoist line guides in slidable communication with the load hoist line, and a plurality of lateral tension line connectors for engaging a plurality of lateral tension lines for providing lateral tension to the first platform, with the plurality of lateral tension lines in communication with a corresponding one of a plurality of lateral tension line length adjusters.

The first platform upper surface comprises first, second, and third assembly hoist line connectors for removably engaging a corresponding one of each of first, second, and third assembly hoist lines. The first platform lower surface comprises first, second, and third control line end connector pairs for removably engaging the first end of each of the first, second, third, fourth, fifth, and sixth control lines. The control line end connector pairs are arranged in a substantially triangular configuration on the first platform lower surface, with first control line end connector pair engaging the first and sixth control lines, the second control line end connector pair engaging the second and third control lines, and the third control line end connector pair engaging the fourth and fifth control lines.

The second platform comprises a second platform upper surface, a second platform lower surface, and a second platform outer edge. The second platform upper surface comprises first, second, third, fourth, fifth, and sixth control line length adjusters for adjusting the length of each of the corresponding first, second, third, fourth, fifth, and sixth control lines. The control line length adjusters are arranged in first, second, and third control line length adjuster pairs in a substantially triangular configuration on the second platform upper surface, and are in communication with the second end of a corresponding one of the first, second, third, fourth, fifth, and sixth control lines. The first control line length adjuster pair comprises first and sixth control line length adjusters, the second control line length adjuster pair comprises second and third control line length adjusters, and the third control line length adjuster pair comprises fourth and fifth control line length adjusters. The second platform upper surface comprises a load hoist receiver for removably receiving the load hoist connector.

The substantially triangular configuration of control line length adjuster pairs is oriented relative to the substantially triangular configuration of control line end connector pairs such that each vertex of the control line length adjuster pairs configuration is at a position diametrically opposed to a side of the control line length adjuster pairs configuration.

The control system comprises first, second, third, fourth, fifth, and sixth tension-sensors in communication with a system controller, with each of the first, second, third, fourth, fifth, and sixth tension sensors associated with a corresponding one of each of the first, second, third, fourth, fifth, and sixth control lines for determining a tension of each of the control lines. A plurality of lateral tension line tension sensors are in communication with the system controller, with each of the plurality of lateral tension line tension sensors associated with a corresponding one of each of the plurality of lateral tension lines for determining a tension of each of the lateral tension lines.

The control system comprises at least one motion sensor for sensing motion of the load, with the motion sensor in communication with the system controller, and at least one proximity sensor for sensing the proximity of the assembly to an objective position, with the proximity sensor also in communication with said system controller.

The control system facilitates stabilization and control of the load by adjusting the position of any one or more of the plurality of lateral tension lines and/or of any one or more of the first, second, third, fourth, fifth, and sixth control lines. The load can also be stabilized and controlled by adjusting the tension in any one or more of the plurality of lateral tension lines and/or in any one or more of the first, second, third, fourth, fifth, and sixth control lines. The load can also be stabilized and controlled with simultaneous position and tension control. The control system comprises an intuitive multi-axis joystick and a computer, thus facilitating manual control, automatic control, or a combination of manual and automatic control.

The present invention, therefore, utilizes a first platform instead of the rider block of the RBTS, and employs additional lateral lines to constrain the yaw of the first platform. The invention also adds the unique RoboCrane capabilities, such as the control cable configuration and kinematic control, by virtue of the second platform suspended from the first platform. The system, therefore, solves the load pendulation problem by providing a suspended, constrained assembly to resist forces and torques incurred from the environment and/or induced by the crane. So long as the lines are all in tension, the load is kinematically constrained with a mechanical stiffness determined by the elasticity of the lines and the suspended load.

Advantages associated with the system include the ability not only to stabilize and control a load while it is being lifted or lowered, but to hold a load stationary in a suspended position, as is desirable when the load is a tool. Advantages associated with the various embodiments of the system include both its ready adaptation to existing single point lift mechanisms, its relatively light weight, and its flexibility, ease, and precision of operation.

BRIEF DESCRIPTION OF THE DRAWINGS

Other objects, features, and advantages of the present invention will become more fully apparent from the following detailed description of the preferred embodiments, the appended claims, and the accompanying drawings. As depicted in the attached drawings:

DESCRIPTION OF THE PREFERRED EMBODIMENTS

Figure 1:
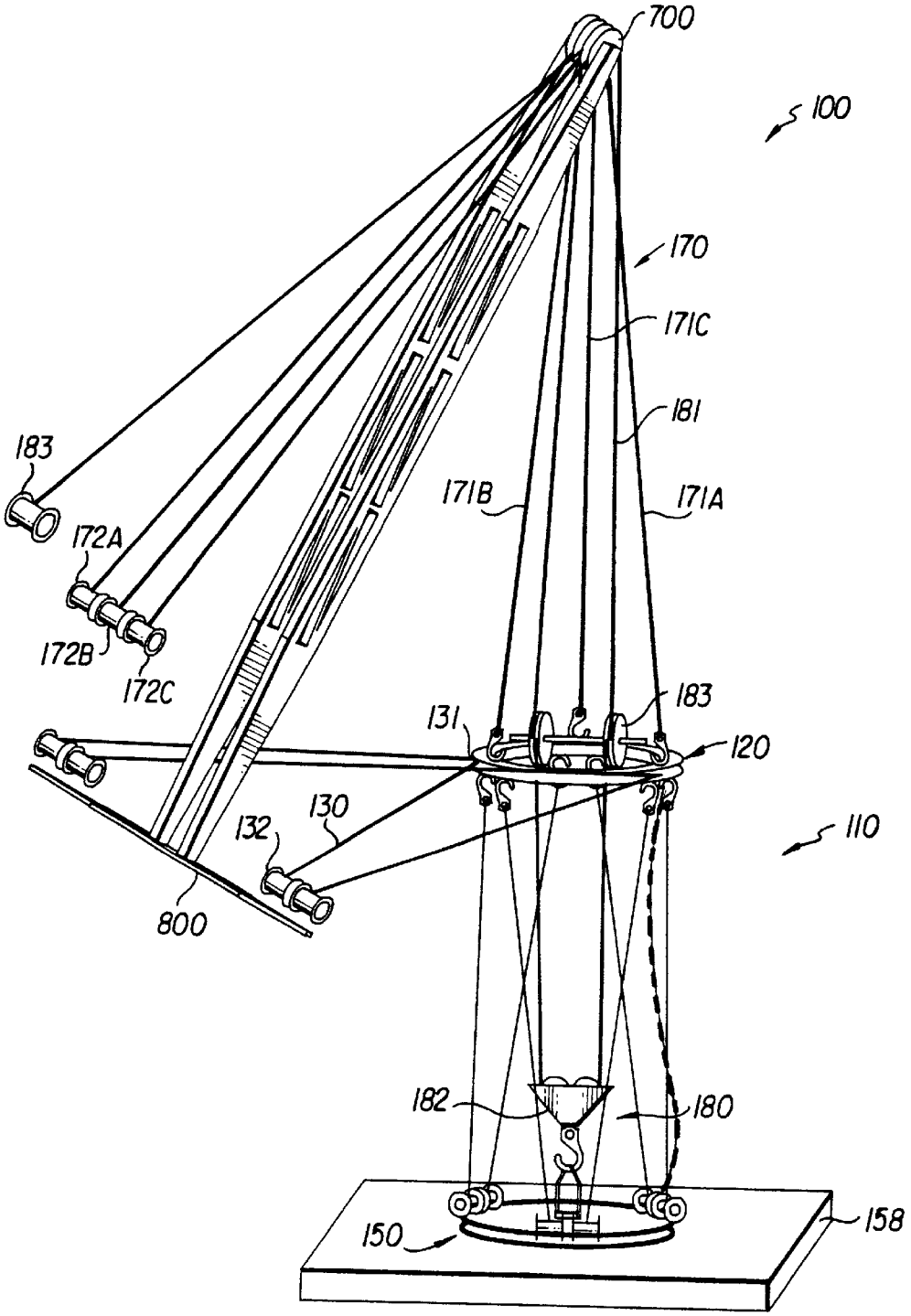
FIG. 1 is a perspective view of a system constructed in accordance with the teachings of a first preferred embodiment of the present invention shown in operative communication with a boom-type crane and a load.

The present invention will be disclosed in terms of the currently perceived preferred embodiments thereof While terminology such as "lift" and "hoist" is employed herein, it should be appreciated that these terms comprehend a system directed to both lifting and/or lowering a load, or holding a load stationary in a suspended position. Furthermore, while the various embodiments of the invention depicted in FIGS. 1, 3, 5, 6, 7, and 9 are directed to a boom-type crane, the present system is equally compatible with other types of lifting means, such as, for example, an overhead bridge gantry-type crane or a tower-type crane.

The present system can precisely control the velocity and force of loads, including tools, in six degrees of freedom. The basic configuration includes a first platform, a second platform, and crossed lateral tension lines, often referred to as "taglines." The first platform is suspended from the main lift point by one or more lines, typically cables, that control its vertical, roll, and pitch motions. The first platform is additionally constrained by the three or more lateral tension lines that extend from the first platform to a beam attached to the crane base or boom base. The lateral tension lines control the x, y, and yaw motions of the first platform. Line length adjusters, such as, for example, winches, control the position of the first platform and can be mounted to the first platform or to the crane.

A second platform, which is preferably rotatable, is suspended from the first platform. Six control lines in a Stewart platform geometry provide full six degrees of freedom (i.e., x, y, z, roll, pitch, and yaw) control of the second platform with respect to the first platform. The second platform is necessary to reach over, for example, ship edges, building walls, or obstacles that would not allow the first platform access to the objective lift point. The second platform also includes a rotator that provides yaw rotation beyond the capability of the reeving. The rotator is necessary to provide full 90° spreader bar rotation.

The kinematic motions of the two platforms can be precisely controlled in position, velocity, and/or force to flexibly fixture loads (e.g., blocks, containers, beams, walls), tools (e.g., spreader bars, saws, grinders, grippers, magnets, robots), and/or equipment (e.g., assemblies, welding equipment, tanks, pipes). These can be maneuvered within the reach of the system defined by the main lift point and the two points at which the lateral tension lines attach to the beam at the base of the boom. The feasibility region for this system in two dimensions is similar to that of the T-ACS crane. The center-of-gravity of the combined platforms cannot reach beyond the imaginary lines formed by the three suspension points and therefore, defines the system work volume. In an alternative embodiment, cantilevered beams and loads can reach outside the work volume so long as the system center-of-gravity remains within the work volume.

The first preferred embodiment of the invention represents that configuration in which the minimum modifications to an existing T-ACS crane or other single point lift device are required. The first embodiment allows the main lift line to pass through the first platform and attach to the second platform. Thus, the second platform can be raised so that the first and second platforms can be brought into relatively close vertical proximity. The separation distance of the first platform from the second platform, however, is limited by both the space occupied by the hook connector of the lift line and the space occupied by the control line length adjusters mounted on the upper surface of the second platform.

The second platform attaches directly to the load and, therefore, provides heavy lift capability from the lift source to the load. The first platform is equipped with line guides, typically pulleys, that guide the lift lines. The assembly can be pulled toward the crane or boom with the lateral tension lines and uses some of the lift line tension to constrain the first platform. The crossed lateral tension lines from the first platform to the lateral tension line beam provide assembly resistance to yaw motions.

In another preferred embodiment of the invention, the main lift line attaches to the first platform. Thus, all suspended loads are passed from the main lift lines, through the first platform, and through control lines between the first and second platforms. As a result of the fact that the main lift line attaches to the first platform, an especially advantageous feature of this embodiment is that the second platform can be raised into close vertical proximity with the first platform.

The assembly is relatively lightweight, and therefore, removes only minimal capacity from the lift system. In the case of an existing lift mechanism such as a T-ACS crane, there is already a lift line in place for the RBTS which provides sufficient lift capacity for the first platform. In this case, only the second platform would be removed from the rated crane capacity. With the present system, it is possible to lift a load of several tons and position it over a large work volume since the crane can also slew (i.e., rotate). Additionally, lateral forces can be resisted or exerted, and/or torques can be applied.

In any of the various embodiments of the invention, simple, intuitive joystick control can be used to control the suspended load. Alternatively, semi-autonomous through full autonomous control modes are also possible. Therefore, the assembly can be driven to precise locations with accuracy and repeatability similar to that achievable with large robots, but while carrying a much heavier payload.

Furthermore, since onboard computer controlled cable positions and tensions can be used to control the load, no ground support, such as tagline personnel, is needed to stabilize the load.

Figure 2:
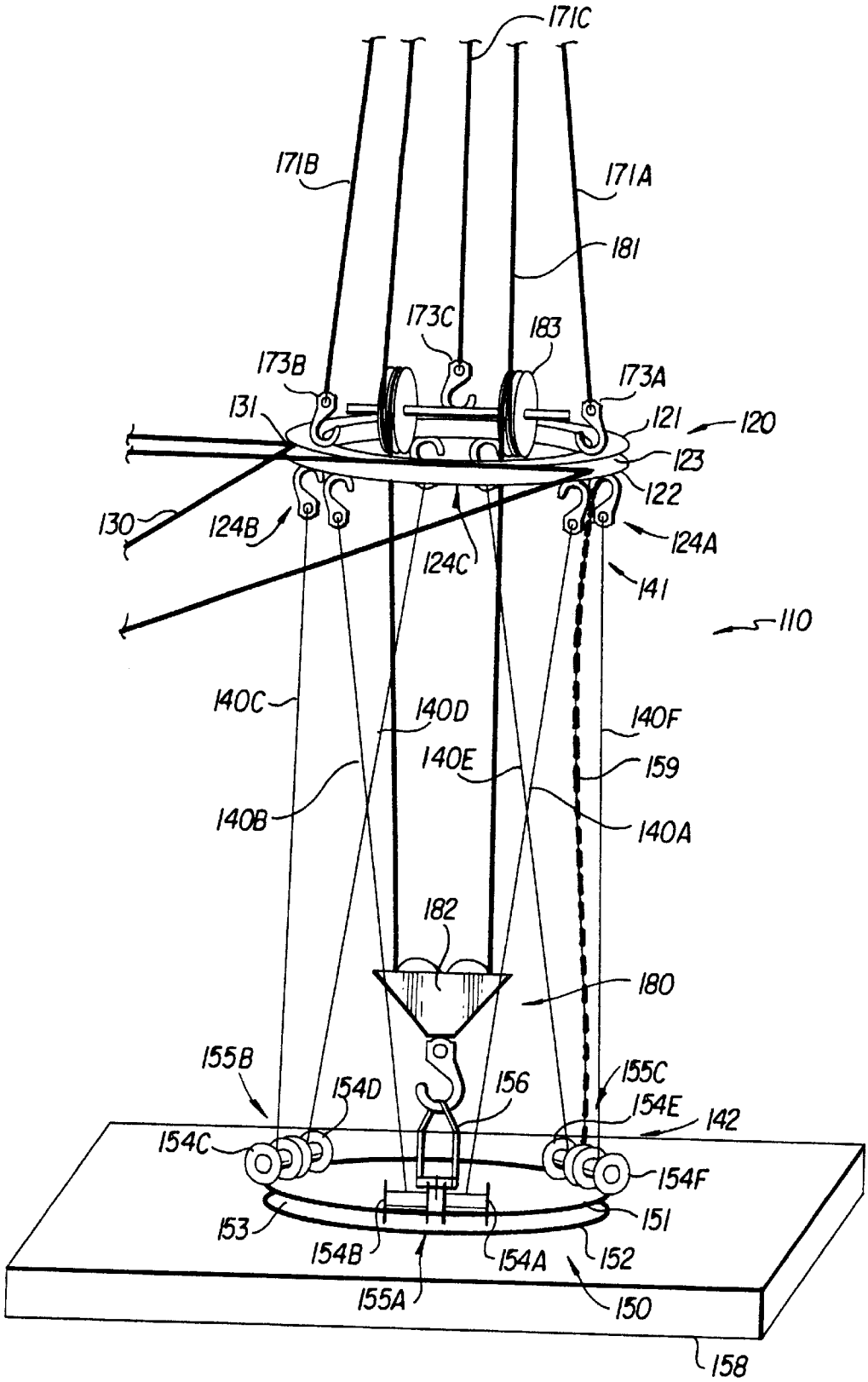
FIG. 2 is a detail view of the embodiment depicted in FIG. 1.
Figure 12:
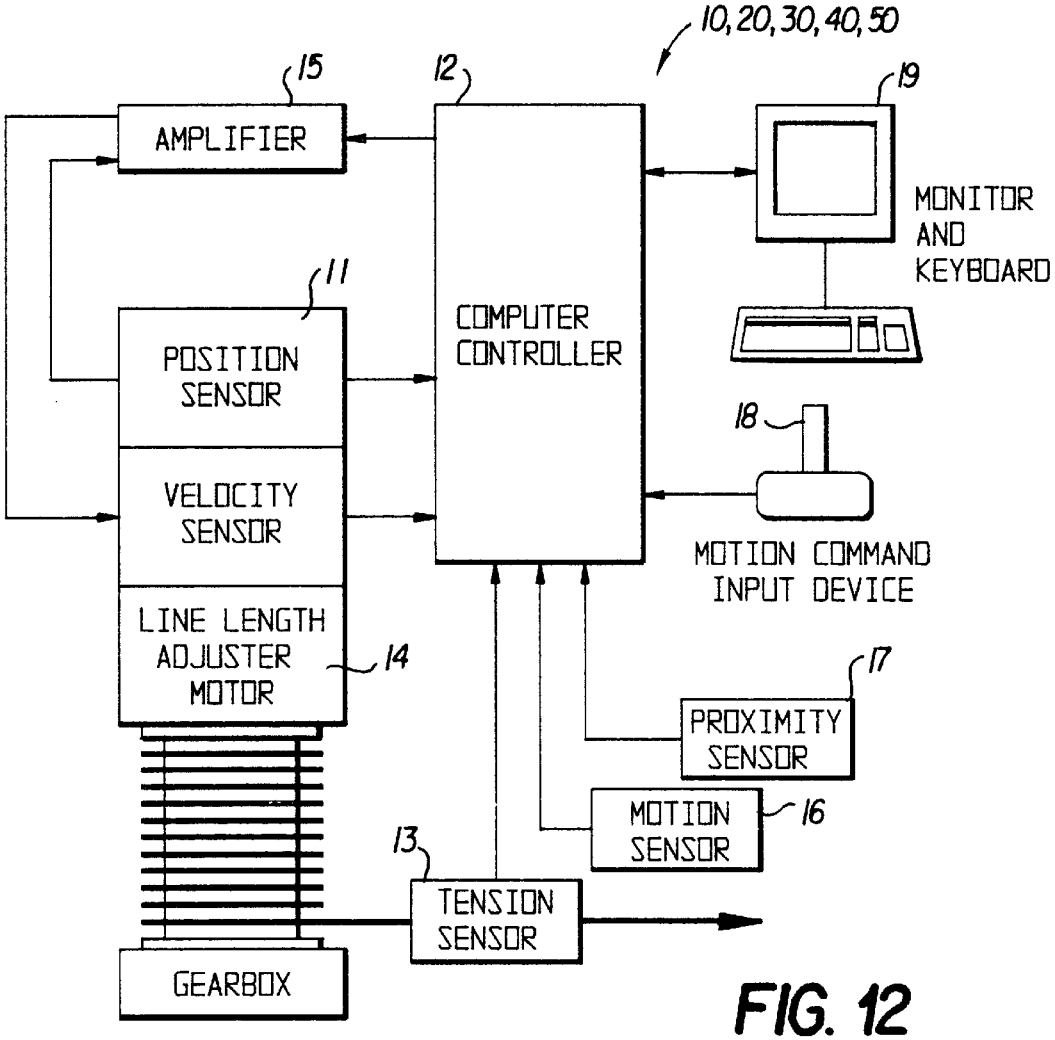
FIG. 12 is a schematic flow diagram of the control system associated with the system embodiments depicted in FIGS. 1–10.

Referring to FIGS. 1 and 2, a system 100 constructed in accordance with the teachings of the aforementioned first preferred embodiment of the present invention is shown. System 100 comprises a suspension point 700, an assembly 110, a lateral tension lines member 800, and a control system 10 (FIG. 12).

Assembly 110 comprises a first platform 120 for positioning the assembly; a second platform 150 disposed below the first platform; first 140A, second 140B, third 140C, fourth 140D, fifth 140E, and sixth 140F control lines having a first end 141 and a second end 142, with the control lines disposed between first platform 120 and second platform 150; an assembly hoist 170, which comprises first 171A, second 171B, and third 171C assembly hoist lines in communication with a corresponding one of each of first 172A, second 172B, and third 172C assembly hoist line length adjusters; and a load hoist 180 which comprises a load hoist line 181 and a load hoist connector 182, with load hoist line 181 in communication with a load hoist line length adjuster 183.

First platform 120 comprises a first platform upper surface 121, a first platform lower surface 122, a first platform outer edge 123, load hoist line guides 183 in slidable communication with load hoist line 181, and a plurality of lateral tension line connectors 131 for engaging a plurality of lateral tension lines 130 for providing lateral tension to first platform 120, with the plurality of lateral tension lines in communication with a corresponding one of a plurality of lateral tension line length adjusters 132.

First platform upper surface 121 comprises first 173A, second 173B, and third 173C assembly hoist line connectors for removably engaging a corresponding one of each of first, second, and third assembly hoist lines. First platform lower surface 122 comprises first 124A, second 124B, and third 124C control line end connector pairs for removably engaging the first end of each of the first, second, third, fourth, fifth, and sixth control lines. The control line end connector pairs are arranged in a substantially triangular configuration on the first platform lower surface, with first control line end connector pair 124A engaging first 140A and sixth 140F control lines, second control line end connector pair 124B engaging second 140B and third 140C control lines, and third control line end connector pair 124C engaging fourth 140D and fifth 140E control lines. In a preferred embodiment, the substantially triangular configuration of control line end connector pairs defines an equilateral triangle.

Second platform 150 comprises a second platform upper surface 151, a second platform lower surface 152, and a second platform outer edge 153. Second platform upper surface 151 comprises first 154A, second 154B, third 154C, fourth 154D, fifth 154E, and sixth 154F control line length adjusters for adjusting the length of each of the corresponding first, second, third, fourth, fifth, and sixth control lines. The control line length adjusters are arranged in first 155A, second 155B, and third 155C control line length adjuster pairs in a substantially triangular configuration on the second platform upper surface, and are in communication with the second end of a corresponding one of the first, second, third, fourth, fifth, and sixth control lines. The first control line length adjuster pair 155A comprises first 154A and second 154B control line length adjusters, the second control line length adjuster pair 155B comprises third 154C and fourth 154D control line length adjusters, and the third control line length adjuster pair 155C comprises fifth 154E and sixth 154F control line length adjusters. In a preferred embodiment, the substantially triangular configuration of control line length adjuster pairs defines an equilateral triangle.

Figure 11:
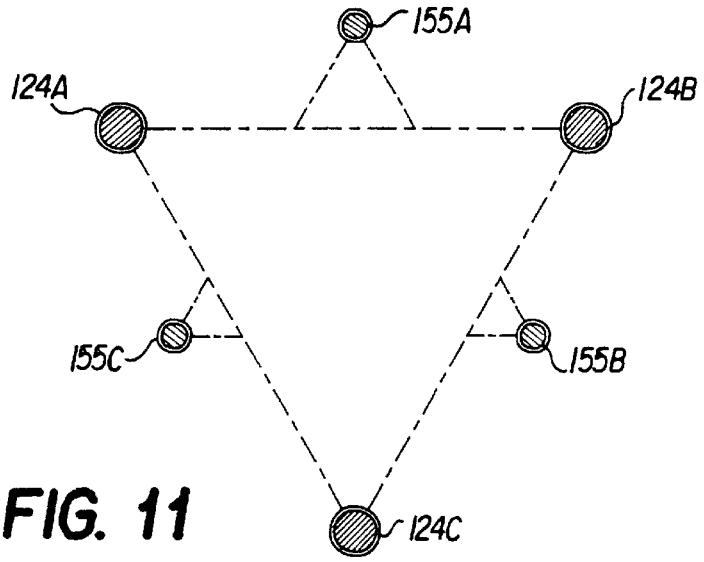
FIG. 11 is a top plan detail view of the orientation of a first platform lower surface control line end connector pairs configuration relative to a second platform upper surface control line length adjuster pairs configuration.

Referring to FIG. 11, a top plan detail view of the orientation of the first platform lower surface control line end connector pairs 124A, 124B, and 124C configuration relative to the second platform upper surface control line length adjuster pairs 155A, 155B, and 155C configuration is shown. The substantially triangular configuration of control line length adjuster pairs is oriented relative to the substantially triangular configuration of control line end connector pairs such that each vertex of the control line length adjuster pairs configuration is at a position diametrically opposed to a side of the control line length adjuster pairs configuration.

Second platform upper surface 151 comprises a load hoist receiver 156 for removably receiving the load hoist connector 182. Second platform lower surface comprises a load connector for removably engaging the load 158, typically by means of a spreader bar. In a preferred embodiment, load connector is rotatable, and is powered by a rotation motor.

The control line length adjusters, the load connector rotation motor, the spreader bar, and any associated equipment can be powered either by a tether 159, or, for untethered performance, by an onboard generator.

Referring to FIG. 12, a schematic flow diagram of the control system associated with the system embodiments depicted in FIGS. 1–10 is shown. For simplicity of illustration, the control system depicted in FIG. 12 includes single sensors to represent the multiple sensors of the present invention. The general elements of such a control system for controlling the position of, and tension in, control lines is described in U.S. Pat. No. 5,507,596 to Bostelman, the disclosure of which is incorporated by reference herein.

The control system comprises a position sensor 11 in communication with a computer controller 12, with each position sensor associated with a corresponding control line, for determining simultaneously a position of each control line/control line length adjuster motor 14. The controller computes the next position for the length adjuster motor to reach and then sends a new command to the amplifier 15 to actuate the motor, which drives the motor to the next position. This cycle is repeated until the controller is satisfied with the sensed position.

Tension control using tension sensor input to the controller is similar to the aforementioned position control except that tension control replaces each position-sensed input to the controller with a tension-sensed input. Adjustment of the control line to the desired tension is the objective intension control.

Simultaneous position and tension control is achieved by providing feedback from both the position and tension sensors to the controller. The operator or controller decides, based on the particular system application, which sensing technique will take precedence—position or tension. If position is selected to take precedence, tension is used to augment the position command to also maintain a desired tension in each line. If tension is selected to take precedence, position is used to augment the tension command to also maintain a desired position of each line.

Proximity control is used to update the position of the assembly with respect to the proximity of an objective position, for example, the position to which a load is to be lowered or the position at which a tool is to be suspended. One or more proximity sensors input proximal system positions to the controller so that a desired system-load separation distance is maintained. As the assembly approaches the objective position, the controller decides whether the assembly should continue along this path or perform another function.

Motion control is used to damp system oscillations caused by environmental or other impacts to the system. As the system receives undesired impacts, sensed by position, tension, proximity, and/or other sensors, the system is controlled so as to minimize the sensed oscillations by moving in the opposite or other direction. Sensed changes in tension can therefore provide information to the controller that the system is moving when it was not commanded to do so. Therefore, the system can react to the changing tensions by moving the system so as to oppose the tension amplitudes.

Control system 10 comprises first, second, third, fourth, fifth, and sixth control line position sensors 11 in communication with controller 12, with each of the first, second, third, fourth, fifth, and sixth control line position sensors associated with a corresponding one of each of the first, second, third, fourth, fifth, and sixth control lines for determining a position of each of the control lines. A plurality of lateral tension line position sensors are in communication with the system controller, with each of the plurality of lateral tension line position sensors associated with a corresponding one of each of the plurality of lateral tension lines for determining a position of each of the lateral tension lines.

Control system 10 comprises first, second, third, fourth, fifth, and sixth tension sensors 13 in communication with controller 12, with each of the first, second, third, fourth, fifth, and sixth tension sensors associated with a corresponding one of each of the first, second, third, fourth, fifth, and sixth control lines for determining a tension of each of the control lines. A plurality of lateral tension line tension sensors are in communication with the system controller, with each of the plurality of lateral tension line tension sensors associated with a corresponding one of each of the plurality of lateral tension lines for determining a tension of each of the lateral tension lines.

Control system 10 comprises at least one motion sensor 16 for sensing motion of the load, with the motion sensor in communication with the controller, and at least one proximity sensor 17 for sensing the proximity of the assembly to an objective position, with the proximity sensor also in communication with the controller.

With control system 10, the load can be stabilized and controlled by adjusting the position of any one or more of the plurality of lateral tension lines and/or of any one or more of the first, second, third, fourth, fifth, and sixth control lines. The load can also be stabilized and controlled by adjusting the tension in any one or more of the plurality of lateral tension lines and/or in any one or more of the first, second, third, fourth, fifth, and sixth control lines. As indicated above, the load can also be stabilized and controlled with simultaneous position and tension control.

Control system 10 comprises a motion command input device 18, such as a multi-axis joystick, in communication with controller 12, and a monitor and keyboard 19, also in communication with controller 12, thus facilitating manual control, automatic control, or a combination of manual and automatic control.

Figure 3:
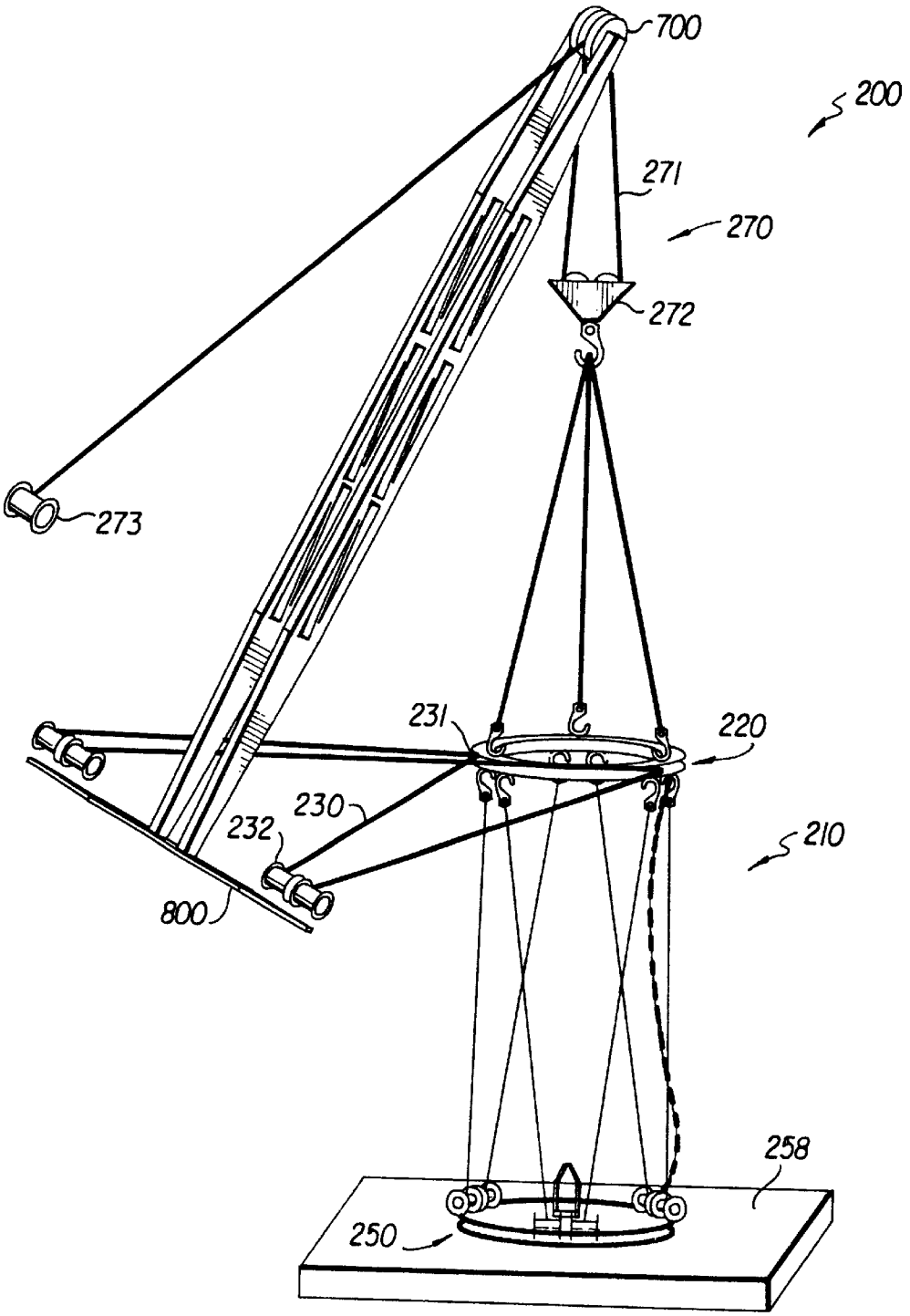
FIG. 3 is a perspective view of a system constructed in accordance with the teachings of a second preferred embodiment of the present invention shown in operative communication with a boom-type crane and a load.
Figure 4:
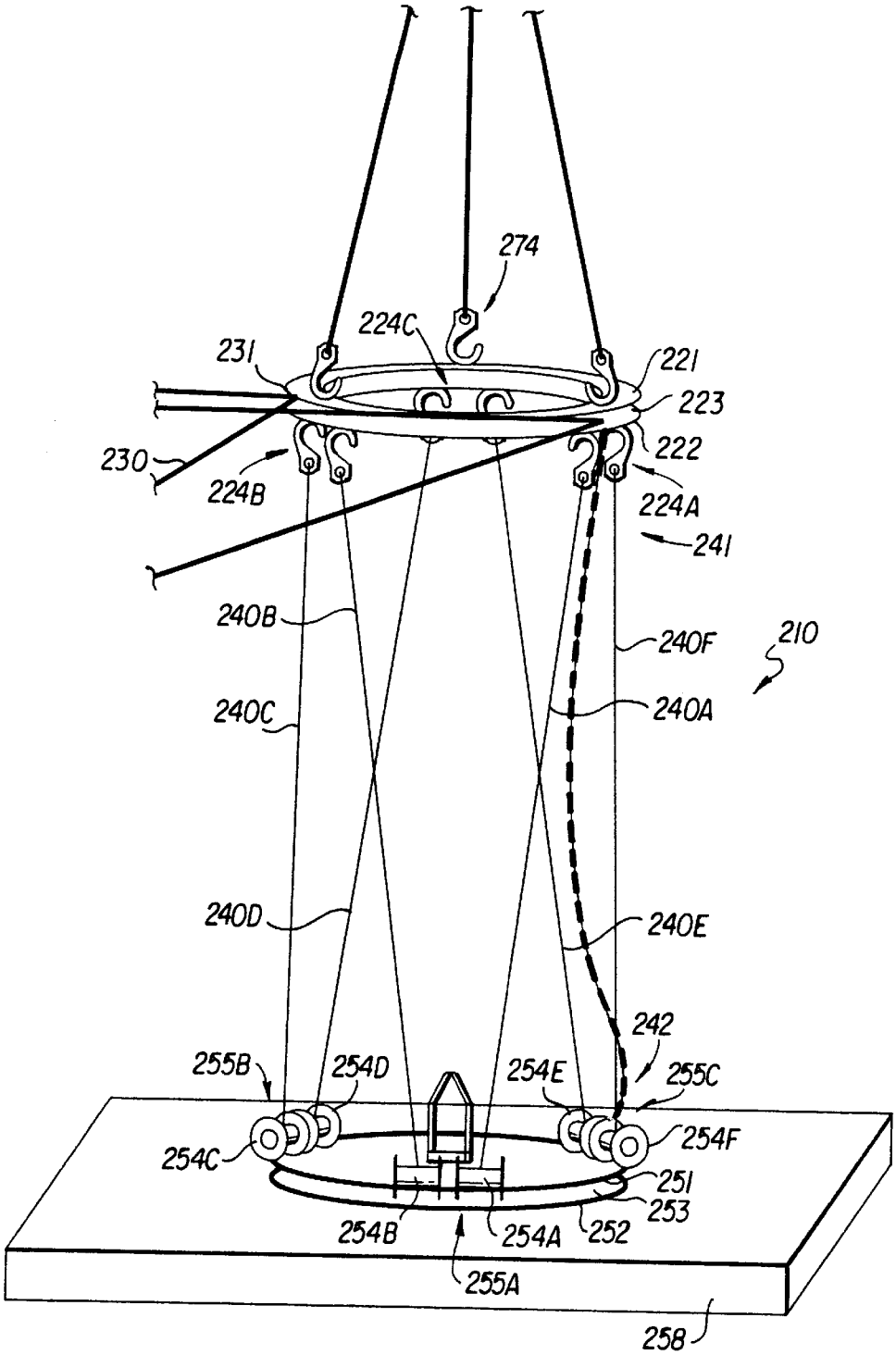
FIG. 4 is a detail view of the embodiment depicted in FIG. 3.

Referring to FIGS. 3 and 4, a system 200 constructed in accordance with the teachings of a second preferred embodiment of the present invention is shown. System 200 comprises a suspension point 700, an assembly 210, a lateral tension lines member 800, and a control system 20 (FIG. 12).

Assembly 210 comprises a first platform 220 for positioning the assembly; a second platform 250 disposed below the first platform; first 240A, second 240B, third 240C, fourth 240D, fifth 240E, and sixth 240F control lines having a first end 241 and a second end 242, with the control lines disposed between first platform 220 and second platform 250; and an assembly/load hoist 270. Assembly/load hoist 270 comprises an assembly/load hoist line 271 and an assembly/load hoist connector 272, with assembly/load hoist line 271 in communication with an assembly/load hoist line length adjuster 273.

First platform comprises a first platform upper surface 221, a first platform lower surface 222, a first platform outer edge 223, and a plurality of lateral tension line connectors 231 for engaging a plurality of lateral tension lines 230 for providing lateral tension to first platform 220, with the plurality of lateral tension lines in communication with a corresponding one of a plurality of lateral tension line length adjusters 232.

First platform upper surface 221 comprises a plurality of assembly/load hoist line connectors 274 for removably engaging the assembly/load hoist. First platform lower surface 222 comprises first 224A, second 224B, and third 224C control line end connector pairs for removably engaging the first end of each of the first, second, third, fourth, fifth, and sixth control lines. The control line end connector pairs are arranged in a substantially triangular configuration on the first platform lower surface, with first control line end connector pair 224A engaging first 240A and sikth 240F control lines, second control line end connector pair 224B engaging second 240B and third 240C control lines, and third control line end connector pair 224C engaging fourth 240D and fifth 240E control lines.

Second platform 250 comprises a second platform upper surface 251, a second platform lower surface 252, and a second platform outer edge 253. Second platform upper surface 251 comprises first 254A, second 254B, third 254C, fourth 254D, fifth 254E, and sixth 254F control line length adjusters for adjusting the length of each of the corresponding first, second, third, fourth, fifth, and sixth control lines. The control line length adjusters are arranged in first 255A, second 255B, and third 255C control line length adjuster pairs in a substantially triangular configuration on the second platform upper surface and are in communication with the second end of a corresponding one of the first, second, third, fourth, fifth, and sixth control lines. The first control line length adjuster pair 255A comprises first 254A and second 254B control line length adjusters, the second control line length adjuster pair 255B comprises third 254C and fourth 254D control line length adjusters, and the third control line length adjuster pair 255C comprises fifth 254E and sixth 254F control line length adjusters. Second platform lower surface 252 comprises a load connector for removably engaging the load 258.

The substantially triangular configuration of control line length adjuster pairs 255A, 255B, and 255C is oriented relative to the substantially triangular configuration of control line end connector pairs 224A, 224B, and 224C such that each vertex of the control line length adjuster pairs configuration is at a position diametrically opposed to a side of the control line length adjuster pairs configuration.

Control system 20 comprises first, second, third, fourth, fifth, and sixth control line position sensors in communication with a controller, with each of the first, second, third, fourth, fifth, and sixth control line position sensors associated with a corresponding one of each of the first, second, third, fourth, fifth, and sixth control lines for determining a position of each of the control lines. A plurality of lateral tension line position sensors are in communication with the system controller, with each of said plurality of lateral tension line position sensors associated with a corresponding one of each of the plurality of lateral tension lines for determining a position of each of the lateral tension lines.

Control system 20 comprises first, second, third, fourth, fifth, and sixth tension sensors in communication with the controller, with each of the first, second, third, fourth, fifth, and sixth tension sensors associated with a corresponding one of each of the first, second, third, fourth, fifth, and sixth control lines for determining a tension of each of the control lines. A plurality of lateral tension line tension sensors are in communication with the controller, with each of the plurality of lateral tension line tension sensors associated with a corresponding one of each of the plurality of lateral tension lines for determining a tension of each of the lateral tension lines.

Control system 20 comprises at least one motion sensor for sensing motion of the load, with the motion sensor in communication with the controller, and at least one proximity sensor for sensing the proximity of the assembly to an objective position, with the proximity sensor also in communication with the controller.

Figure 5:
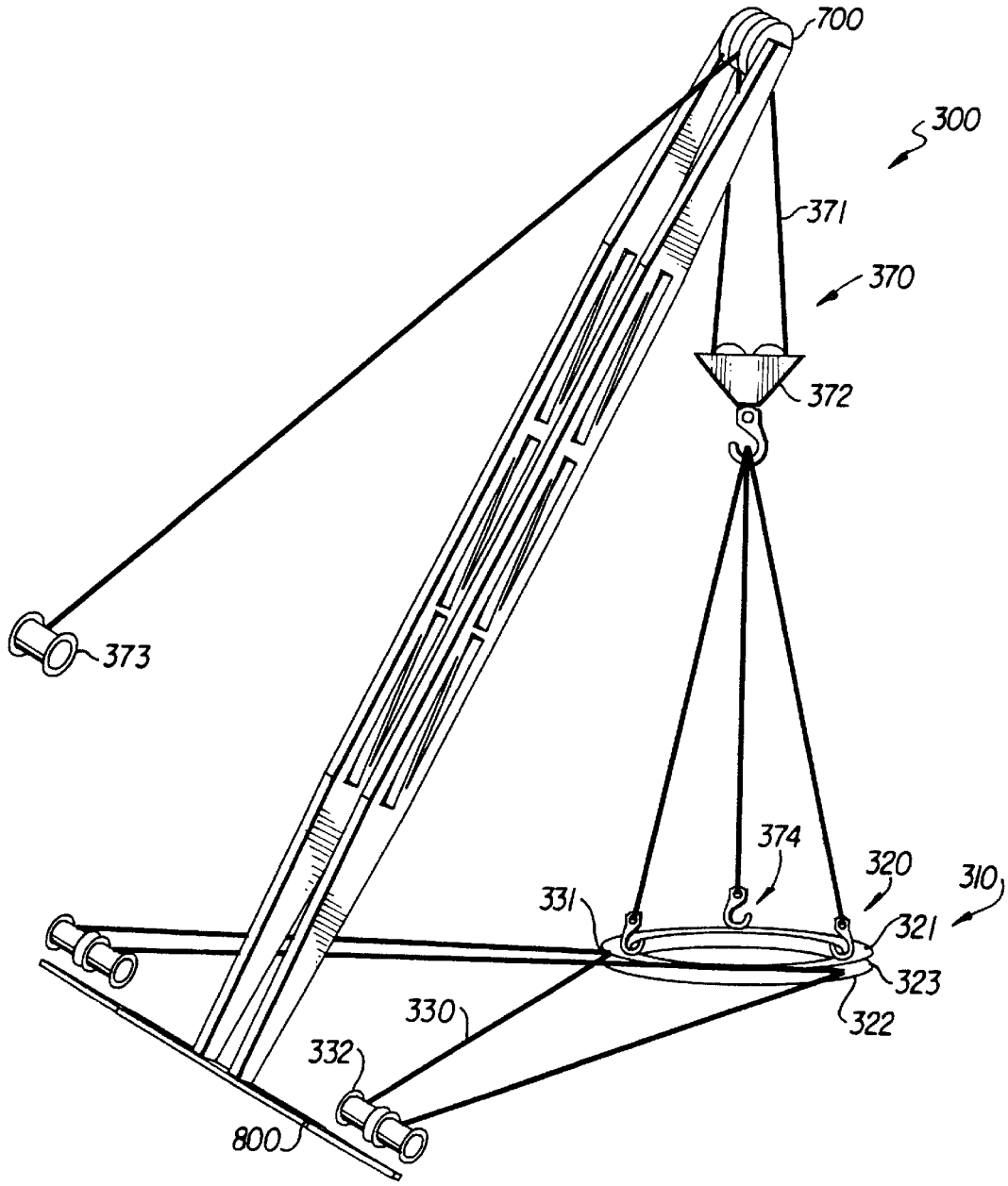
FIG. 5 is a perspective view of a system constructed in accordance with the teachings of a third preferred embodiment of the present invention shown in operative communication with a boom-type crane.

Referring to FIG. 5, a system 300 constructed in accordance with the teachings of a third preferred embodiment of the present invention is shown. System 300 comprises a suspension point 700, an assembly 310, a lateral tension lines member 800, and a control system 30 (FIG. 12).

Assembly 310 comprises a platform 320 and an assembly/load hoist 370. Assembly/load hoist 370 comprises an assembly/load hoist line 371 and an assembly/load hoist connector 372, with assembly/load hoist line 371 in communication with an assembly/load hoist line length adjuster 373.

Platform 320 comprises a platform upper surface 321, a platform lower surface 322, a platform outer edge 323, and a plurality of lateral tension line connectors 331 for engaging a plurality of lateral tension lines 330 for providing lateral tension to the platform, with the plurality of lateral tension lines in communication with a corresponding one of a plurality of lateral tension line length adjusters 332.

Platform upper surface 321 comprises a plurality of assembly/load hoist line connectors 374 for removably engaging assembly/load hoist 370, and platform lower surface 322 comprises a load connector for removably engaging the load.

Control system 30 comprises a plurality of lateral tension line position sensors in communication with a controller, with each of the plurality of lateral tension line position sensors associated with a corresponding one of each of the plurality of lateral tension lines for determining a position of each of the lateral tension lines. A plurality of lateral tension line tension sensors are in communication with the controller, with each of the plurality of lateral tension line tension sensors associated with a corresponding one of each of the plurality of lateral tension lines for determining a tension of each of the lateral tension lines.

Control system 30 comprises at least one motion sensor for sensing motion of the load, with the motion sensor in communication with the controller, and at least one proximity sensor for sensing the proximity of the assembly to an objective position, with the proximity sensor also in communication with the controller.

Figure 6:
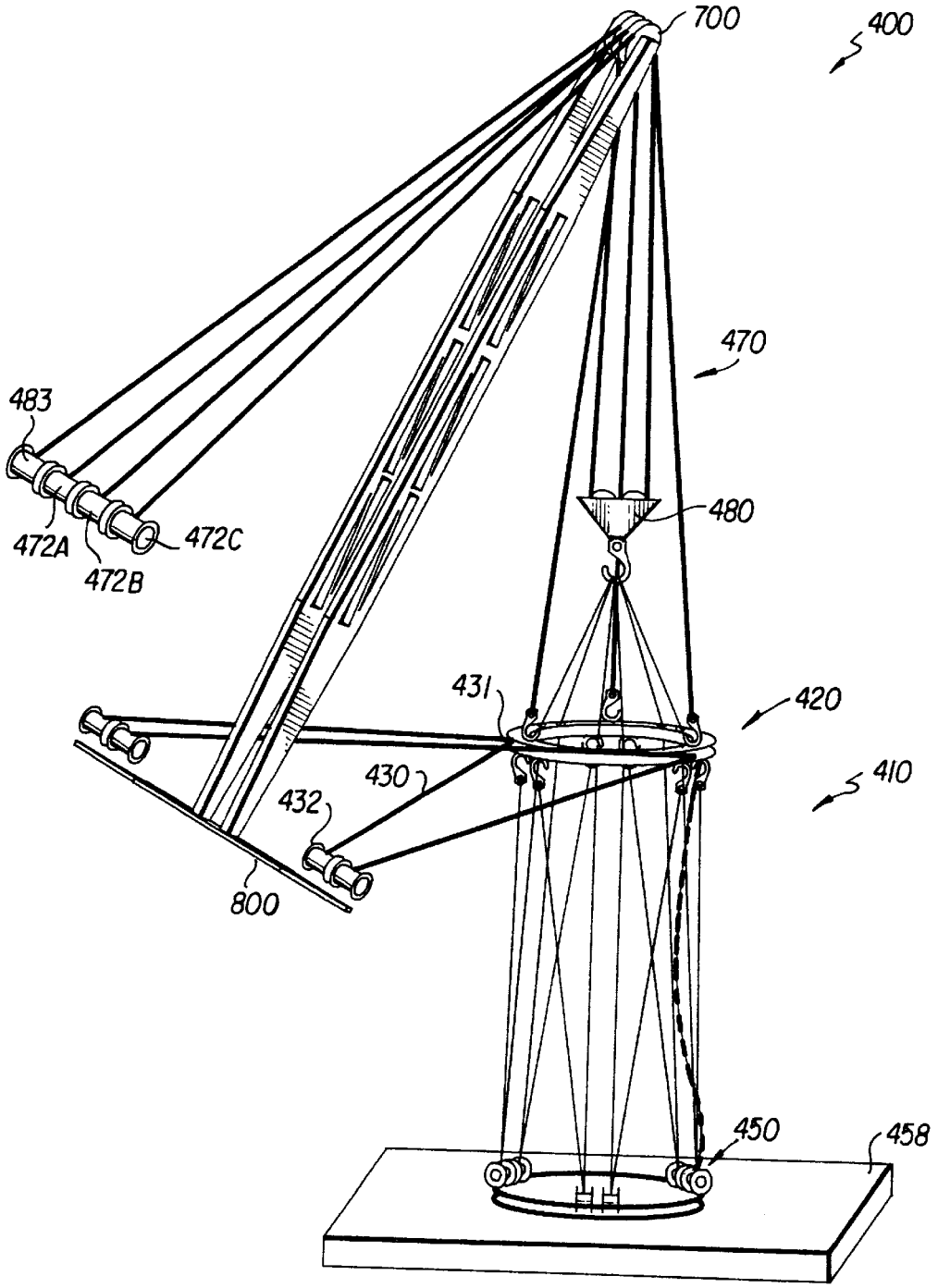
FIG. 6 is a perspective view of a system constructed in accordance with the teachings of a fourth preferred embodiment of the present invention shown in operative communication with a boom-type crane and a load.
Figure 7:
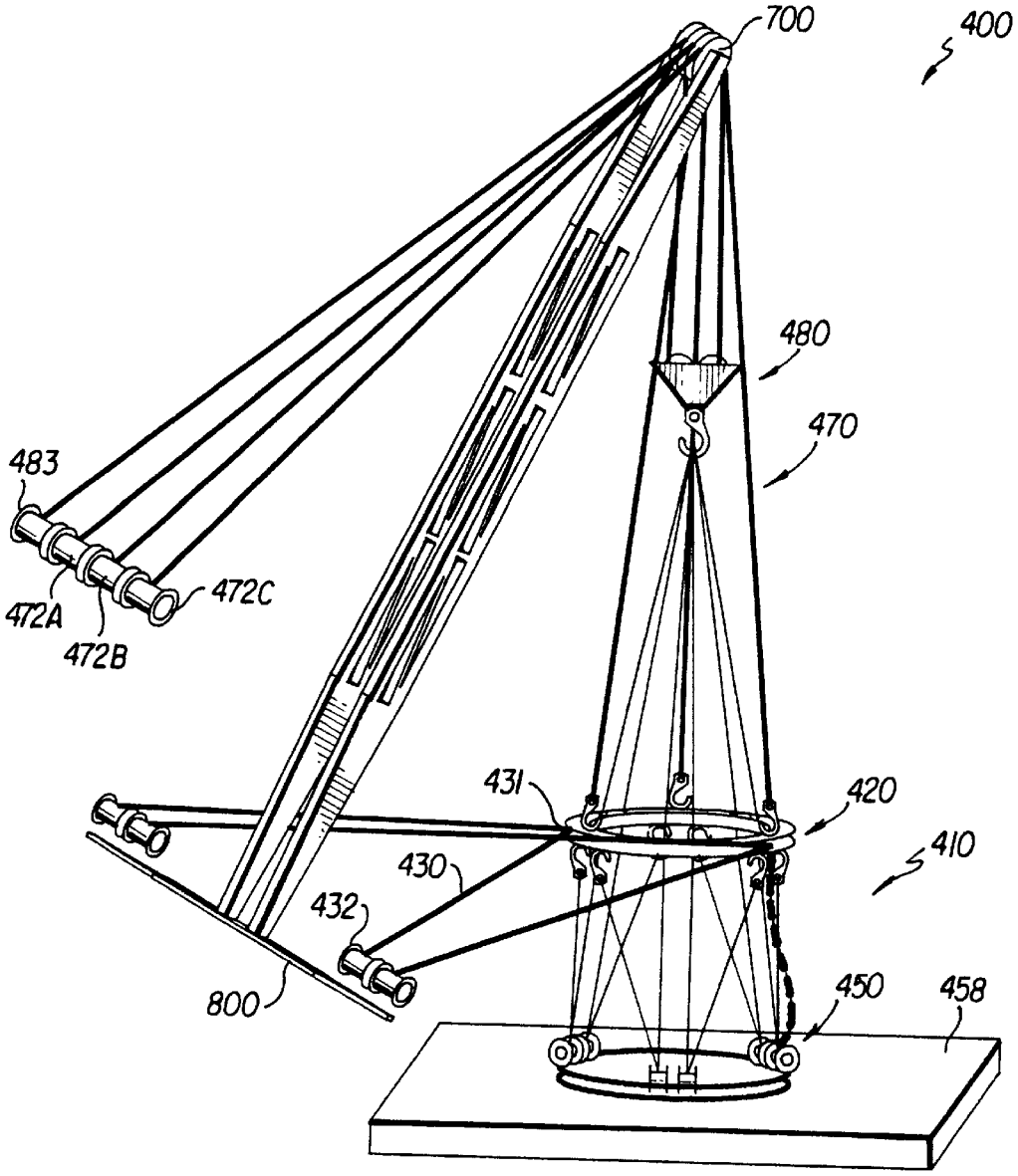
FIG. 7 is a perspective view of the embodiment depicted in FIG. 6 in which the load has been hoisted relative to the position of the load depicted in FIG. 6.
Figure 8:
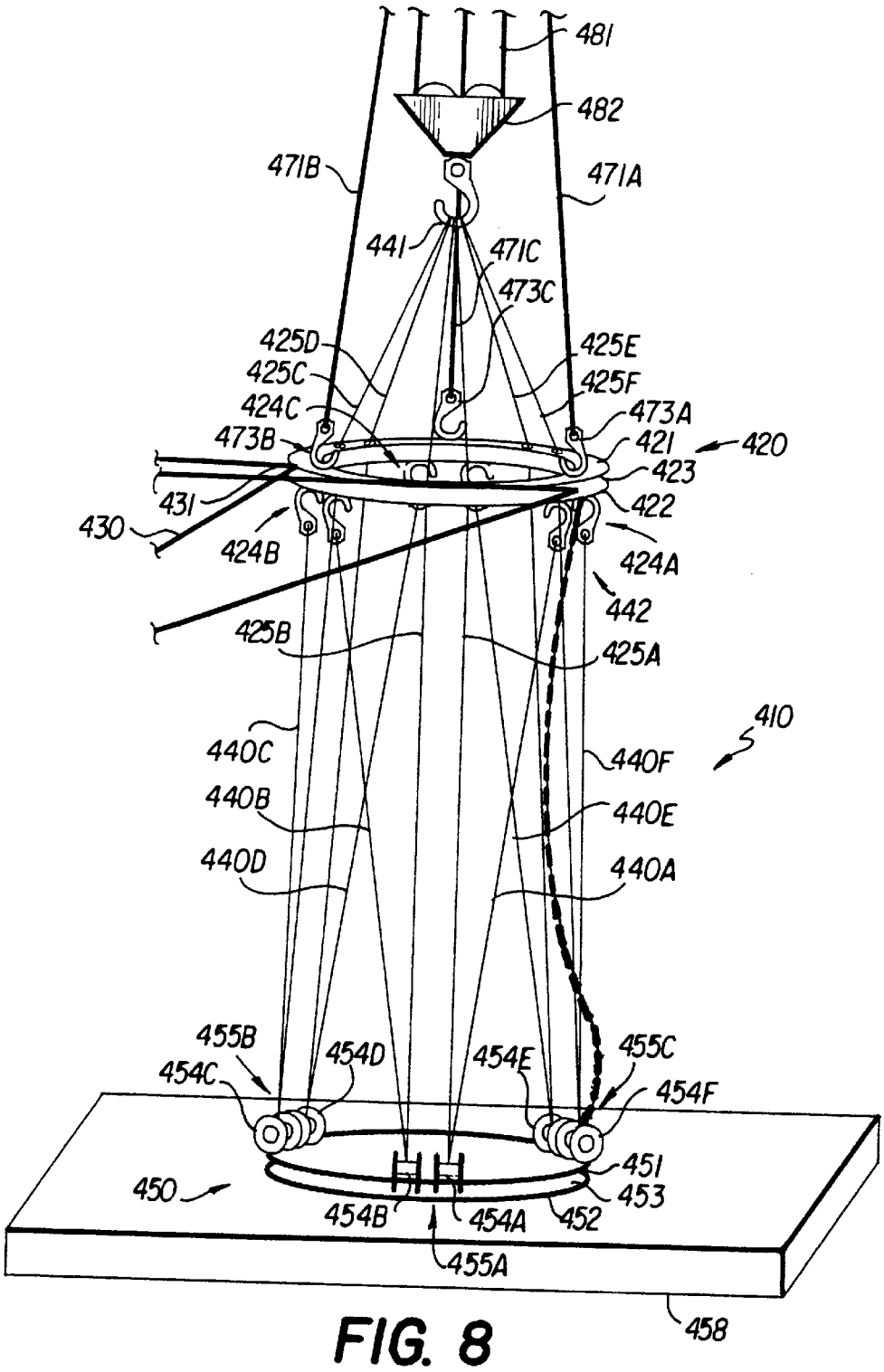
FIG. 8 is a detail view of the embodiment depicted in FIGS. 6 and 7.

Referring to FIGS. 6, 7, and 8, a system 400 constructed in accordance with the teachings of a fourth preferred embodiment of the present invention is shown. System 400 comprises a suspension point 700, an assembly 410, a lateral tension lines member 800, and a control system 40 (FIG. 12).

Assembly 410 comprises a first platform 420 for positioning the assembly; a second platform 450 disposed below the first platform; first 440A, second 440B, third 440C, fourth 440D, fifth 440E, and sixth 440F control lines having a first end 441 and a second end 442; an assembly hoist 470, which comprises first 471A, second 471B, and third 471C assembly hoist lines in communication with a corresponding one of each of first 472A, second 472B, and third 472C assembly hoist line length adjusters; and a load hoist 480 which comprises a load hoist line 481 and a load hoist line connector 482, with the load hoist line 481 in communication with a load hoist line length adjuster 483, and the first end 441 of each of the control lines removably connected to the load hoist line connector 482.

First platform 420 comprises a first platform upper surface 421, a first platform lower surface 422, a first platform outer edge 423, first 425A, second 425B, third 425C, fourth 425D, fifth 425E, and sixth 425F control line upper guides in slidable communication with a corresponding one of each of the control lines, and a plurality of lateral tension line connectors 431 for engaging a plurality of lateral tension lines 430 for providing lateral tension to first platform 420, with the plurality of lateral tension lines in communication with a corresponding one of a plurality of lateral tension line length adjusters 432.

First platform upper surface 421 comprises first 473A, second 473B, and third 473C assembly hoist line connectors for removably engaging a corresponding one of each of first, second, and third assembly hoist lines. First platform lower surface 422 comprises first 424A, second 424B, and third 424C control line end connector pairs for removably engaging second end 442 of each of the first, second, third, fourth, fifth, and sixth control lines. The control line end connector pairs are arranged in a substantially triangular configuration on the first platform lower surface, with first control line end connector pair 424A engaging first 440A and sixth 440F control lines, second control line end connector pair 424B engaging second 440B and third 440C control lines, and third control line end connector pair 424C engaging fourth 440D and fifth 440E control lines.

Second platform 450 comprises a second platform upper surface 451, a second platform lower surface 452, and a second platform outer edge 453. Second platform upper surface 451 comprises first 454A, second 454B, third 454C, fourth 454D, fifth 454E, and sixth 454F control line lower guides in slidable communication with a corresponding one of each of the control lines. The control line lower guides are arranged in first 455A, second 455B, and third 455C control line lower guide pairs in a substantially triangular configuration on the second platform upper surface. First control line lower guide pair 455A comprises first 454A and second 454B control line lower guides, second control line lower guide pair 455B comprises third 454C and fourth 454D control line lower guides, and third control line lower guide pair 455C comprises fifth 454E and sixth 454F control line lower guides. Second platform lower surface 452 comprises a load connector for removably engaging the load 458.

The substantially triangular configuration of control line lower guide pairs 455A, 455B, and 455C is oriented relative to the substantially triangular configuration of control line end connector pairs 424A, 424B, and 424C such that each vertex of the control line lower guide pairs configuration is at a position diametrically opposed to a side of the control line end connector pairs configuration.

Control system 40 comprises a plurality of lateral tension line position sensors in communication with a controller, with each of the plurality of lateral tension line position sensors associated with a corresponding one of each of the plurality of lateral tension lines for determining a position of each of the lateral tension lines. A plurality of lateral tension line tension sensors are in communication with the controller, with each of the plurality of lateral tension line tension sensors associated with a corresponding one of each of the plurality of lateral tension lines for determining a tension of each of the lateral tension lines.

Control system 40 comprises at least one motion sensor for sensing motion of the load, with the motion sensor in communication with the controller, and at least one proximity sensor for sensing the proximity of the assembly to an objective position, with the proximity sensor also in communication with the controller.

Figure 9:
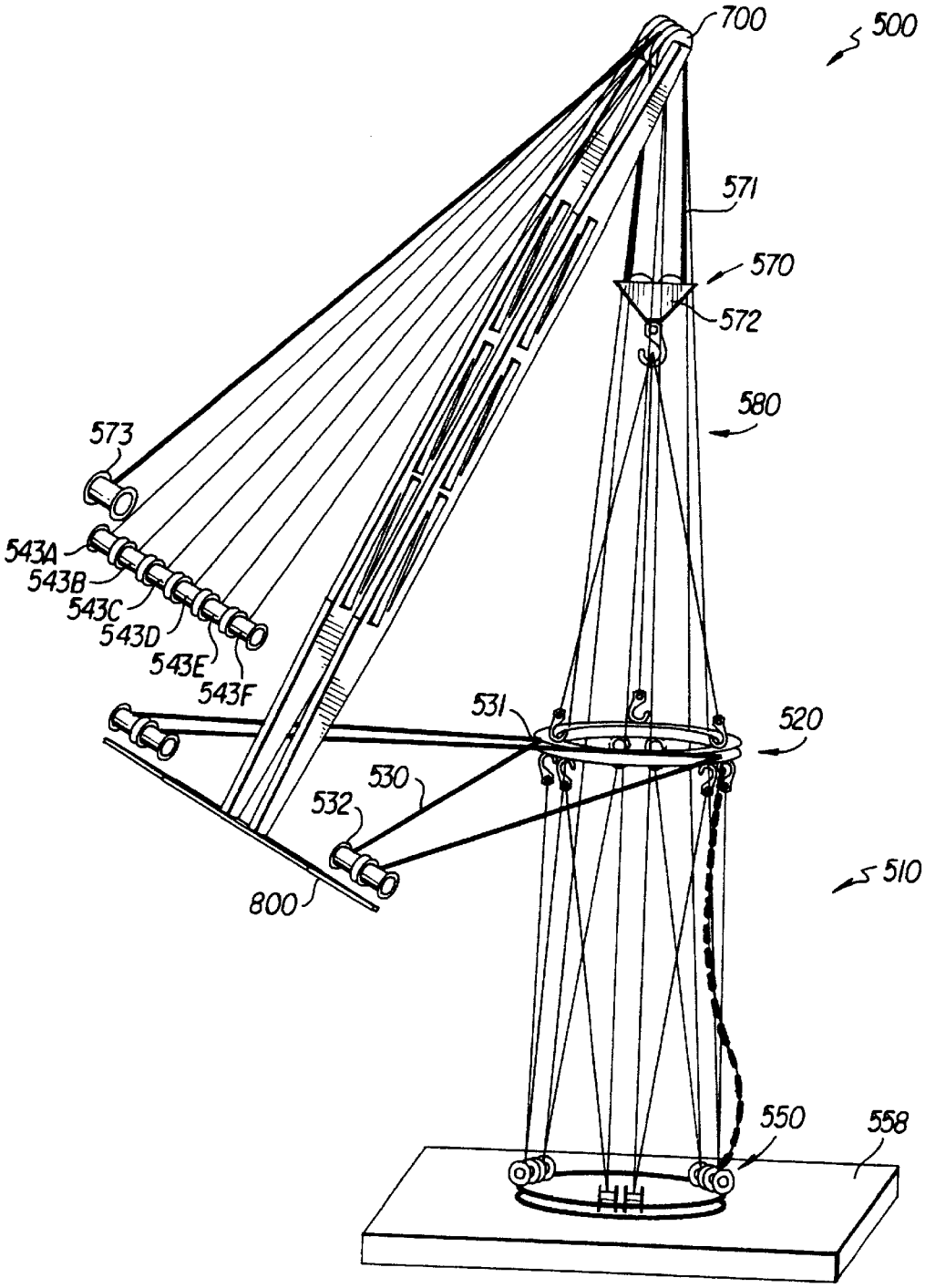
FIG. 9 is a perspective view of a system constructed in accordance with the teachings of a fifth preferred embodiment of the present invention shown in operative communication with a boom-type crane and a load.
Figure 10:
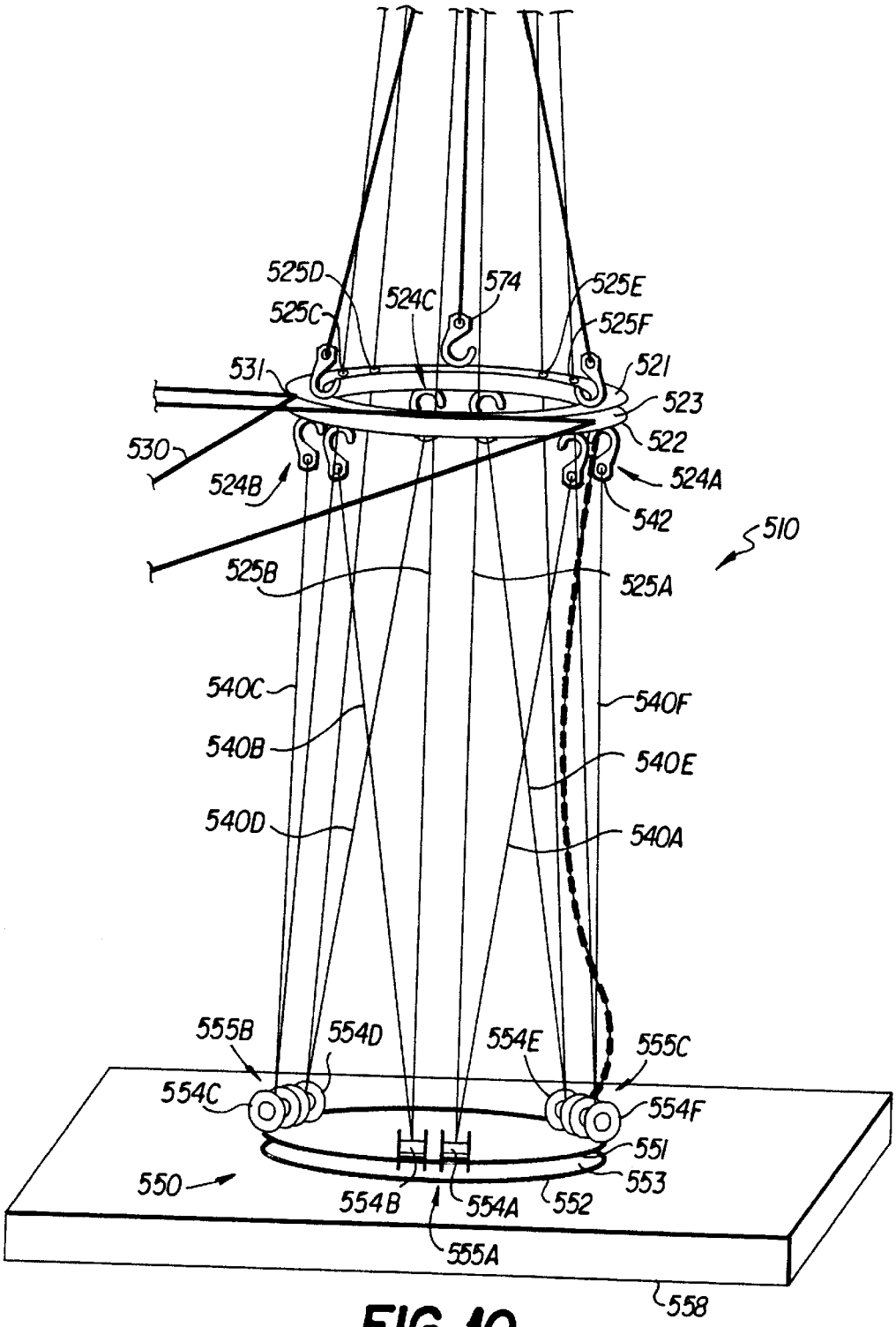
FIG. 10 is a detail view of the embodiment depicted in FIG. 9.

Referring to FIGS. 9 and 10, a system 500 constructed in accordance with the teachings of a fifth preferred embodiment of the present invention is shown. System 500 comprises a suspension point 700, an assembly 510, a lateral tension lines member 800, and a control system 50 (FIG. 12).

Assembly 510 comprises a first platform 520 for positioning the assembly; a second platform 550 disposed below the first platform; first 540A, second 540B, third 540C, fourth 540D, fifth 540E, and sixth 540F control/load hoist lines having a first end 541 and a second end 542, with the first end of each of the control/load hoist lines in communication with a corresponding one of each of first 543A, second 543B, third 543C, fourth 543D, fifth 543E, and sixth 543F control/load hoist line length adjusters; and an assembly hoist 570 which comprises an assembly hoist line 571 and an assembly hoist connector 572, with assembly hoist line 571 in communication with an assembly hoist line length adjuster 573.

First platform 520 comprises a first platform upper surface 521, a first platform lower surface 522, a first platform outer edge 523, first 525A, second 525B, third 525C, fourth 525D, fifth 525E, and sixth 525F control/load hoist line upper guides in slidable communication with a corresponding one of each of the control/load hoist lines, and a plurality of lateral tension line connectors 531 for engaging a plurality of lateral tension lines 530 for providing lateral tension to first platform 520, with the plurality of lateral tension lines 530 in communication with a corresponding one of a plurality of lateral tension line length adjusters 532.

First platform upper surface 521 comprises a plurality of assembly hoist line connectors 574 for removably engaging assembly hoist 570. First platform lower surface 522 comprises first 524A, second 524B, and third 524C control/load line end connector pairs for removably engaging second end 542 of each of the first, second, third, fourth, fifth, and sixth control/load hoist lines. The control/load hoist line end connector pairs are arranged in a substantially triangular configuration on the first platform lower surface, with first control/load hoist line end connector pair 524A engaging first 540A and sixth 540F control/load hoist lines, second control/load hoist line end connector pair 524B engaging second 540B and third 540C control/load hoist lines, and third control/load hoist line end connector pair 524C engaging fourth 540D and said fifth 540E control/load hoist lines.

Second platform 550 comprises a second platform upper surface 551, a second platform lower surface 552, and a second platform outer edge 553. Second platform upper surface 551 comprises first 554A, second 554B, third 554C, fourth 554D, fifth 554E, and sixth 554F control/load hoist line lower guides in slidable communication with a corresponding one of each of the control/load hoist lines. The control/load hoist line lower guides are arranged in first 555A, second 555B, and third 555C control/load hoist line lower guide pairs in a substantially triangular configuration on the second platform upper surface. First control/load hoist line lower guide pair 555A comprises first 554A and second 554B control/load hoist line lower guides, second control/load hoist line lower guide pair 555B comprises third 554C and fourth 554D control/load hoist the lower guides, and third control/load hoist line lower guide pair 555C comprises fifth 554E and sixth 554F control/load hoist line lower guides. Second platform lower surface 552 comprises a load connector for removably engaging the load 558.

The substantially triangular configuration of control/load hoist line lower guide pairs 555A, 555B, and 555C is oriented relative to the substantially triangular configuration of control/load hoist line end connector pairs 524A, 524B, and 524C such that each vertex of the control/load hoist line lower guide pairs configuration is at a position diametrically opposed to a side of the control/load hoist line end connector pairs configuration.

Control system 50 comprises first, second, third, fourth, fifth, and sixth control/load hoist line position sensors in communication with a controller, with each of the first, second, third, fourth, fifth, and sixth control/load hoist line position sensors associated with a corresponding one of each of the first, second, third, fourth, fifth, and sixth control/load hoist lines for determining a position of each of the control/load hoist lines. A plurality of lateral tension line position sensors are in communication with the controller, with each of the plurality of lateral tension line position sensors associated with a corresponding one of each of the plurality of lateral tension lines for determining a position of each of the lateral tension lines.

Control system 50 comprises first, second, third, fourth, fifth, and sixth tension sensors in communication with the controller, with each of the first, second, third, fourth, fifth, and sixth tension sensors associated with a corresponding one of each of the first, second, third, fourth, fifth, and sixth control/load hoist lines for determining a tension of each of the control/load hoist lines. A plurality of lateral tension line tension sensors are in communication with the controller, with each of the plurality of lateral tension line tension sensors associated with a corresponding one of each of the plurality of lateral tension lines for determining a tension of each of the lateral tension lines.

Control system 50 comprises at least one motion sensor for sensing motion of the load, with the motion sensor in communication with the controller, and at least one proximity sensor for sensing the proximity of the assembly to an objective position, with the proximity sensor also in communication with the controller.

The present invention, therefore, provides a system for stabilizing and controlling in six degrees of freedom the movement of a hoisted load. The system not only facilitates stabilizing and controlling a load while it is being lifted or lowered, but facilitates holding a load stationary in a suspended position, as is desirable when the load is a tool. Advantages associated with the various embodiments of the system include both its ready adaptation to existing hoists and relatively light weight, and its flexibility and precision of operation, including the ability to offer manual control, automatic control, or a combination of manual and automatic control.

While only certain preferred embodiments of this invention have been shown and described by way of illustration, many modifications will occur to those skilled in the art. For example, while the system has been depicted in the context of a boom-type crane application and has been described as being applicable to onboard ship service, its operation is equally applicable to other types of cranes and to any service which requires that the movement of a load hoisted by a single point lift mechanism be stabilized and controlled in six degrees of freedom.

For example, conventional boom cranes used on nearly all medium to large scale construction sites could integrate the present system to resist environmental perturbations and/or precisely place loads with safety and efficiency. Applications also exist in the nuclear waste industry, where highly dangerous loads are currently maneuvered using cranes with little or no motion compensation. Such unsafe methods can be eliminated through use of the present system.

Furthermore, depending upon the specific load suspended from the second platform (or platform, in the third embodiment of the invention), the system offers substantial flexibility in terms of being able to perform a wide variety of tasks.

For example, for cutting, the platform can manipulate a variety of saws (e.g., wire saw or disc saw), rotary cutting tools (router, milling tool, grinding tool), abrasive jet tools (e.g., water jet, air jet), flame cutters, or chisels for cutting steel, plastics, or wood. The platform can produce large forces with accuracies sufficient for many types of machining operations, including, for example, milling, routing, drilling, grinding, and polishing.

For excavating and grading, the platform can manipulate digging devices (e.g., augers, scrapers) precisely over the ground in either a manual or computer controlled mode. Soil can be removed in large volumes with great precision.

For shaping and finishing, the platform can manipulate grinders, polishers, buffers, paint sprayers, sandblasters, and welding torches over large objects (e.g., ship hulls, structural steel, castings and weldments, and concrete structures). It can apply controlled amounts of force and resist perturbations in all directions.

For lifting and positioning, the platform can be fitted with a variety of gripping devices to lift and precisely position loads. The platform can exert controlled forces to mate and seat loads and can resist perturbations such as wind and inertial forces. Precision motions of potentially 0.125 inches and 0.5 degrees can be achieved while maneuvering loads in manual, semi-autonomous, and autonomous control modes.

While the FIG. 11 top plan detail view of the relative orientation of the substantially triangular configurations has been described above in association with the first embodiment of the invention, it should be appreciated that the same relative orientation is applicable to the second, third, fourth, and fifth embodiments of the invention. In addition, in any of the aforementioned embodiments, a preferred embodiment is that in which each of the substantially triangular configurations defines an equilateral triangle.

While the rotatable load connector, rotation motor, spreader bar, power tether, and alternative onboard generator have been described above in association with the first embodiment of the invention, it should be appreciated that the same features are applicable to the second, third, fourth, and fifth embodiments of the invention.

Furthermore, while the various modes of control have been described above in association with the first embodiment of the invention, it should be appreciated that the same features are applicable to the second, third, fourth, and fifth embodiments of the invention. That is, the system affords wide control flexibility, since, as indicated above, the load can be stabilized and controlled with position control, tension control, or simultaneous position and tension control. Additionally, each embodiment of the control system comprises a multi-axis joystick and a computer, thus facilitating manual control, automatic control, or a combination of manual and automatic control.

By way of further example of modifications within the scope of this invention, while the substantially triangular configurations have been described as defining an equilateral triangle in a preferred embodiment, another embodiment could define an isosceles triangle.

By way of further example of modifications within the scope of this invention, while the embodiments of the invention depicted in FIGS. 1, 6, and 7 utilize a dedicated line length adjuster for each of the three assembly hoist lines, it should be appreciated that the three assembly hoist lines could terminate in a single length adjuster if the associated lesser degree of control would be acceptable.

It is, therefore, desired that it be understood that it is intended herein to cover all such modifications that fall within the true spirit and scope of this invention.

What is claimed is:

1. A system for stabilizing and controlling in six degrees of freedom the movement of a hoisted load, said system comprising:

(a) a suspension point, (b) an assembly, (c) a lateral tension lines member, and (d) a control system, said assembly comprising (i) a first platform for positioning said assembly, (ii) a second platform disposed below said first platform, (iii) first, second, third, fourth, fifth, and sixth control lines having a first end and a second end, said control lines disposed between said first platform and said second platform, and (iv) an assembly/load hoist, said assembly/load hoist comprising an assembly/load hoist line and an assembly/load hoist connector, said assembly/load hoist line in communication with an assembly/load hoist line length adjuster, said first platform comprising a first platform upper surface, a first platform lower surface, a first platform outer edge, and a plurality of lateral tension line connectors for engaging a plurality of lateral tension lines for providing lateral tension to said first platform said plurality of lateral tension lines in communication with a corresponding one of a plurality of lateral tension line length adjusters, said first platform upper surface comprising a plurality of assembly/load hoist line connectors for removably engaging said assembly/load hoist, said first platform lower surface comprising first, second, and third control line end connector pairs for removably engaging said first end of each of said first, second, third, fourth, fifth, and sixth control lines, said control line end connector pairs being arranged in a substantially triangular configuration on the first platform lower surface, said first control line end connector pair engaging said first and said sixth control lines, said second control line end connector pair engaging said second and said third control lines, and said third control line end connector pair engaging said fourth and said fifth control lines, said second platform comprising a second platform upper surface, a second platform lower surface, and a second platform outer edge, said second platform upper surface comprising first, second, third, fourth, fifth, and sixth control line length adjusters for adjusting the length of each of said corresponding first, second, third, fourth, fifth, and sixth control lines, said control line length adjusters being arranged in first, second, and third control line length adjuster pairs in a substantially triangular configuration on the second platform upper surface and in communication with said second end of a corresponding one of said first, second, third, fourth, fifth, and sixth control lines, said first control line length adjuster pair comprising said first and said sixth control line length adjusters, said second control line length adjuster pair comprising said second and said third control line length adjusters, and said third control line length adjuster pair comprising said fourth and said fifth control line length adjusters, wherein said substantially triangular configuration of control line length adjuster pairs is oriented relative to said substantially triangular configuration of control line end connector pairs such that each vertex of the control line length adjuster pairs configuration is at a position diametrically opposed to a side of the control line length adjuster pairs configuration, said second platform lower surface comprising a load connector for removably engaging said load.

2. A system for stabilizing and controlling according to claim 1, wherein said control system comprises:

(i) first, second, third, fourth, fifth, and sixth control line position sensors in communication with a controller, each of said first, second, third, fourth, fifth, and sixth control line position sensors associated with a corresponding one of each of said first, second, third, fourth, fifth, and sixth control lines for determining a position of each of said control lines, (ii) a plurality of lateral tension line position sensors in communication with said controller, each of said plurality of lateral tension line position sensors associated with a corresponding one of each of said plurality of lateral tension lines for determining a position of each of said lateral tension lines, (iii) first, second, third, fourth, fifth, and sixth tension sensors in communication with said controller, each of said first, second, third, fourth, fifth, and sixth tension sensors associated with a corresponding one of each of said first, second, third, fourth, fifth, and sixth control lines for determining a tension of each of said control lines, (iv) a plurality of lateral tension line tension sensors in communication with said controller, each of said plurality of lateral tension line tension sensors associated with a corresponding one of each of said plurality of lateral tension lines for determining a tension of each of said lateral tension lines, (v) at least one motion sensor for sensing motion of the load, said motion sensor in communication with said controller, and (vi) at least one proximity sensor for sensing the proximity of the assembly to an objective position, said proximity sensor in communication with said controller.

* * * * *